US006470805B1

(12) United States Patent
Woodall et al.

(10) Patent No.: US 6,470,805 B1
(45) Date of Patent: Oct. 29, 2002

(54) FIRE RETARDANT BIO-FRIENDLY PRACTICE MUNITION

(75) Inventors: Robert Woodall, Panama City Beach, FL (US); Felipe Garcia, Panama City, FL (US); Chris Doyle, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/845,116

(22) Filed: Apr. 30, 2001

(51) Int. Cl.[7] ..... F42B 12/46; F42B 29/00

(52) U.S. Cl. ..... 102/370; 102/404; 102/405; 102/489; 102/502

(58) Field of Search ..... 102/370, 502, 102/404, 405, 489

(56) References Cited

U.S. PATENT DOCUMENTS 2,920,566 A * 1/1960 Barker ..... 102/370
2,963,975 A * 12/1960 Musser ..... 102/370
3,707,918 A * 1/1973 Dunfee et al. ..... 102/370
3,820,465 A * 6/1974 Delphia ..... 102/502 X
5,107,767 A * 4/1992 Schneider et al. ..... 102/489 X
5,210,372 A * 5/1993 Tripptrap et al. ..... 102/489
5,233,127 A * 8/1993 Sauvestre et al. ..... 102/489
5,287,810 A * 2/1994 Aumasson et al. ..... 102/489
5,317,975 A * 6/1994 Sauvestre et al. ..... 102/489
5,423,264 A * 6/1995 Siegler et al. ..... 102/489 X
5,631,441 A * 5/1997 Briere et al. ..... 102/370 X

FOREIGN PATENT DOCUMENTS

DE 2518918 * 11/1976 ..... 102/370

* cited by examiner

*Primary Examiner*—Peter A. Nelson
(74) *Attorney, Agent, or Firm*—Harvey A. Gilbert; Donald G. Peck

(57) ABSTRACT

Munitions are dropped from military aircraft to quickly combat large area fires within vast threatened regions. Each munition has a shell-shaped case having a chamber containing an air-bag power module and fire retardant. A lid closes one end of the chamber, and switches on the case provide signals for the air-bag power module to suddenly forcefully displace the lid from the chamber by the air-bag module and suddenly forcefully eject the fire retardant from the chamber and out of the case by the air-bag module. Munitions containing fire retardant can be targeted accurately at single hot spots, isolated structures, and along fire lines or can be quickly and accurately dropped to create a protected zone behind an area that has been made not to burn by munitions to protect fire fighters trapped in the path of runaway fires. Munitions are deployed from aircraft by military crewmen without requiring additional training.

17 Claims, 1 Drawing Sheet

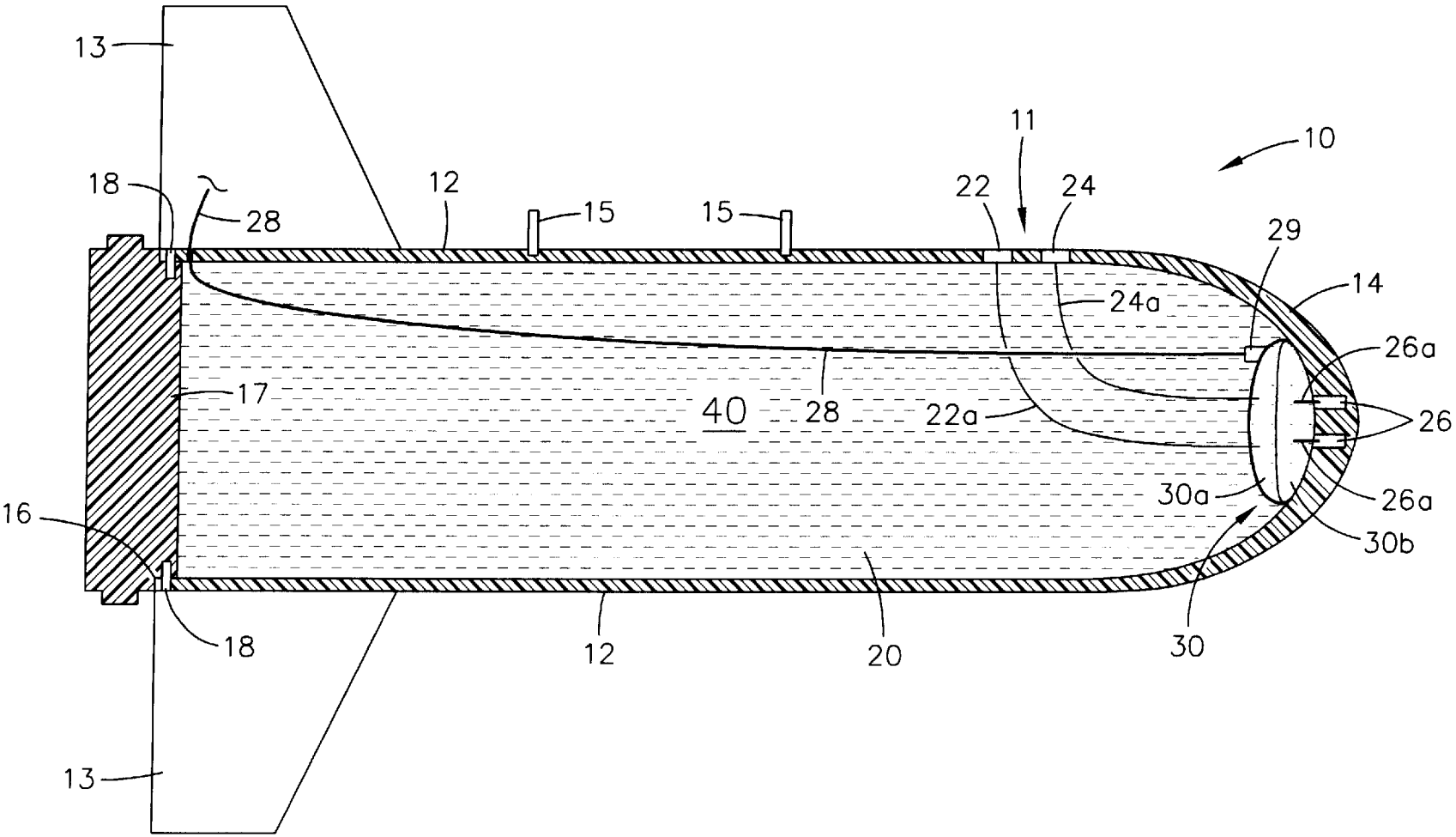
10
11
12
12
13
13
14
15
15
16
17
18
18
20
22
22a
24
24a
26
26a
26a
28
28
29
30
30a
30b
40

FIRE RETARDANT BIO-FRIENDLY PRACTICE MUNITION

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to quickly deployable munitions to fight fires. More particularly, sufficient numbers of the fire retardant munitions of this invention can be accurately dropped from military aircraft to suppress fires.

During the worst fire season in recent years, more than 50 fires burned more than 500,000 acres nationwide, according to the National Fire Information Center. Flames burned large areas in Arizona, Colorado, Idaho, Montana, Mississippi, Nevada, New Mexico, Texas, Utah, Washington and Wyoming.

Typical of the extent of the devastation are: a fire triggered by lightning in Nevada scorched about 65,000 acres about 60 miles northeast of Elko; 50,000 acres burned in Montana in Custer National Forest, homes were threatened in the Northern Cheyenne Reservation, and fires near Helena had blackened nearly 23,000 acres; a fire consumed more than 23,000 acres in 10 days and uncovered more than 12 new archaeological sites while endangering the ancient Anasazi ruins in Colorado; a 77,000-acre blaze raged in the Salmon-Challis National Forest in Idaho; seven fires burned in Utah, including a 38,700-acre blaze in Fishlake National Forest; numerous fires in California took more than a week to contain, including a blaze that scorched more than 63,000 acres in California's Sequoia National Forest while destroying several homes nearby.

One system to combat such blazes over large areas is the aerial delivery system known as the modular airborne fire fighting system (MAFFS). The MAFFS Program was established by Congress to combat wild land fires by the U.S. Forest Service and, when requested, is implemented by several units in the Air National Guard (ANG) and Air Force Reserve (AFR). MAFFS usually assist with fighting fires on wild lands during extreme conditions and when there is "imminent danger" to life and property, and other aerial resources are committed.

Each MAFFS unit is a pressurized 3,000-gallon five-tank system designed for installation in C-130 aircraft without structural modification to the aircraft. MAFFS are "single-shot" systems, meaning that the full load is discharged at one time. This means that about 3,000 gallons of retardant are discharged in about five seconds through two tubes exiting the rear ramp of the plane, and this one load may lay down a "line" about one-quarter-mile-long and sixty feet wide.

Only eight MAFFS are available and each one without any fire retardant weighs approximately 10,000 pounds and must be used on the limited numbers of C-130 aircraft. These MAFFS-fitted aircraft must fly close to the fire in order to deliver their load of retardant, and often they cannot fly into canyons to effectively quench fires.

MAFFS provide firefighters a needed boost in capabilities. However, the resources of MAFFS are stretched thin when compared to the extent of the fire threat and the costs of having personnel trained and maintained in a state of readiness may be prohibitive. Since there are not enough trained professional firefighters to contain wild fires that threaten structures, life, and livestock, primary reliance for fighting fires must be placed in the hands of massive numbers of ground forces that are quickly trained and may be not well suited for the task. More practical solutions still are needed that will be of value and benefit to both the Forest Service and the military services.

Thus, in accordance with this inventive concept, a need has been recognized in the state of the art for quickly deployable, effective means for combating large area fires within vast threatened regions.

SUMMARY OF THE INVENTION

The present invention provides a munition and method of deploying munitions for fighting fires. Each munition has a shell-shaped case having a nose portion at one end, a cylindrical portion connected to the nose portion, and an open end portion connected to the cylindrical portion at its opposite end. The case has an internal chamber, and an air-bag power module and fire retardant are contained in the chamber. A lid closes the open end portion of the chamber, and switches on the case provide signals for the air-bag power module to create sudden forceful displacement of the lid from the open end portion by the air bag module and sudden forceful ejection of the fire retardant from the chamber, through the open end portion, and out of the shell-shaped case by the air-bag power module.

An object of the invention is to provide a quickly deployable fire fighting tool to combat large area fires within vast threatened regions.

Another object is to provide a fire fighting munition to suppress fires being dropped from aircraft capable of deploying standard bombs.

Another object is to provide munitions containing fire retardant deployed at multiple sites from a single aircraft.

Another object is to provide munitions containing fire retardant that can be targeted accurately at single hot spots, isolated structures, along fire lines and internal to a fire zone.

Another object is to provide munitions containing fire retardant deployed from high altitudes with great accuracy from high capacity military aircraft to control a fire.

Another object is to provide munitions containing fire retardant deployed from high altitudes with great accuracy from high capacity military aircraft to create protected zones quickly for fire fighters trapped by runaway fires.

Another object is to provide munitions containing fire retardant effectively deployed to control fires from military aircraft without requiring additional training beyond the training bomber crews already have.

Another object of the invention is to provide for deployment of munitions containing fire retardant in support of fire fighting efforts by the Forest Service while simultaneously training and giving practice to military crews.

Another object of the invention is to provide for accurate deployment of munitions containing fire retardant under all conditions to precise GPS guided coordinates using military-fielded Joint Direct Attack Munition/Joint StandOff Weapon kits.

Another object of the invention is to provide for safe and accurate deployment of munitions containing fire retardant for fire suppression when large fires break out far from shores aboard aircraft carriers, tankers, and oil rigs.

Another object of the invention is to provide for safe and accurate deployment of munitions containing fire retardant for fire suppression without introducing the problems associated with metallic clutter in the environment.

Another object of the invention is to provide for safe and accurate deployment of biodegradable munitions for fire suppression having seeds and/or fertilizer for restoration of the environment.

Another object of the invention is to provide for safe and accurate deployment of biodegradable containers having seeds and/or fertilizers to aid in environmental restoration.

These and other objects of the invention will become more readily apparent from the ensuing specification when taken in conjunction with the appended claims.

BRIEF DESCRIPTION OF THE DRAWINGS

The FIGURE shows a cross-sectional view of the munition of the invention for permitting safe and accurate suppression of fires.

DESCRIPTION OF THE PREFERRED EMBODIMENT

Referring to the FIG. munition 10 of this invention provides a practicable solution for suppressing fires. Munition 10 is an effective tool for fighting localized fires that otherwise could quickly spread and, if unchecked, could devastate large areas of grasslands in open range and of brush and forests in hilly or mountainous regions. Munition 10 of this invention is quickly and accurately dropped on fires in sufficient numbers to put them out or stop their progress. Munition 10 and its method of deployment avoid a main problem associated with successfully combating fires by conventional techniques, viz., the inability to bring sufficient firefighting resources to deal with the fire quickly before it grows to unmanageable proportions. Munition 10 and its method of deployment also avoid main problems associated with using tanker aircraft, viz., funding and manpower constraints and usually not enough of them to counter wild fires over vast areas. Munition 10 and its method of deployment avoids hazards to personnel and equipment, viz., since tanker aircraft must fly relatively close to the fire to effectively deliver their load of fire retardant, turbulence, smoke, and the difficult terrain of ridges and canyons make previous fire fighting techniques extremely hazardous, (about one hundred pilots have been lost in the past forty years).

Munition 10 has a shell-shaped case 11 having cylindrical portion 12, a nose portion 14 at one end and an open end portion 16 formed in the configuration of a conventional general-purpose bomb, such as an MK82 bomb. Like the general purpose bomb, cylindrical portion 12 of case 11 has mounting lugs 15 to be engaged by an aircraft.

Lugs 15 are connected to cylindrical portion 12 of shell-shaped case 11 to couple munition 10 to an aircraft bomb rack to allow stowage of many such munitions 10 during transit to a wild fire and accurate air dropping of munitions 10 from the aircraft. Accuracy and precision placement of munitions 10 is assured since all the sophisticated navigational and bombing instrumentations can be utilized during deployment of a multitude of munitions 10 of the invention.

Cylindrical portion 12 of case 11 mounts stabilizing fins 13 secured adjacent to open end portion 16 that is disposed at its end opposite from nose portion 14. Fins 13 orthogonally extend radially outwardly in an equal distantly spaced relationship from one another (only two of the four are shown in the drawing). A disc-shaped lid 17 is sized to be fitted and retained in a sealed relationship in open end portion 16 of case 11 by shear pins 18. Shell-shaped case 11 forms an internal chamber 20 closed by lid 17 and is integrally molded from biodegradable thermoplastics using a number of different molding techniques, and fins 13, lid 17 and shear pins 18 also may be fabricated from biodegradable materials to reduce environmental impact.

Cylindrical portion 12 and nose portion 14 and/or internal chamber 20 are fitted with an adjustable altitude (pressure) switch 22, a "G"-switch 24, two impact, or crush switches 26, and a safety release enabling line 28 connected to a safety switch 29. Adjustable altitude (pressure) switch 22 is preset to respond to a predetermined altitude and produce enabling control signals that are coupled to lead 22*a*. G-switch 24 creates activation control signals coupled to lead 24*a* when munition impacts the canopy of the forest it is dropped into, and impact switches 26 create activation control signals coupled to leads 26*a* when munition 10 impacts the ground. Safety release enabling line 28 is secured between the aircraft and a safety switch 29 connected to an air-bag power module 30 of munition 10 to assure that there is no untimely activation of air-bag power module 30 of munition 10 during stowage on bomb racks and transit to the site of the fire while munition 10 is aboard the aircraft.

Air-bag power module 30 is secured in chamber 20 adjacent to the inside of nose portion 14 to create a sudden powerful force to eject a fire retardant compound 40 from munition 10 when enabled and activated by appropriate control signals. Air-bag power module 30 can function similarly to the air-bag mechanisms that are found in most modern automobiles that suddenly inflate a flexible, or elastic air-bag structure 30*a* by pressurized gas from an interconnected source 30*b* of pressurized gas. Optionally, air-bag power module 30 could have a source 30*b* of pyrotechnic, such as a Department Of Transportation Class C pyrotechnic, to suddenly, forcefully expand air-bag structure 30*a* of air-bag power module 30. After being enabled, (placed in a ready-state after receiving enabling control signals from pressure switch 22), air-bag power module 30 is ready to be activated. Activation of air-bag power module 30 occurs when activation control signals are received by it from "G" switch 24, or impact switches 26. The activation causes air-bag structure 30*a* of air-bag power module 30 to be suddenly inflated and push fire retardant compound 40 against lid 17 until pins 18 are sheared and lid 17 is pushed out of open end portion 16, and virtually all of fire retardant compound 40 is forcefully ejected through open end portion 16 and out of munition 10. Actuation may be also controlled by an altitude switch, proximity sensor and/or pressure switch.

Many different types of environmentally-friendly biodegradable fire suppressant or retardant compound 40 could be used so long as they are effective and environmentally friendly. Any compound selected for fire retardant compound 40 has the ability to slow or check the spread of fire. For example, a fire retardant compound 40 can be chosen to be one that will biodegrade into fertilizer, however other compounds can be used so long as safety precautions are considered. One typical compound is the ammonium phosphate flame-retardant marketed under the trademark PHOS-CHECK D75R by Monsanto Inc. 800 N. Lindberg Blvd., St. Louis, Mo. 63167.

During fire season, military aircraft at an airbase near fire hazardous regions may be loaded, or stowed with full racks of munitions 10. Each munition 10 is fitted to a bomb rack of an aircraft via its mounting lugs 15 by ground crews in much the same way as general purpose bombs are loaded. Each safety release enabling line 28 is attached to the bomb rack of the aircraft and extends to safety switch 29 in each munition 10 to assure inhibition of its air-bag power module 30 until after munition 10 is taken to a drop site and dropped from the aircraft, and line 28 is pulled free from safety switch 29. Each altitude switch 22 is preset for the desired altitude where its interconnected air-bag power module 30 is to be enabled for activation.

When a call for suppression of a fire is received, a military aircraft loaded with a full load of munitions 10 takes off and is directed to the area being overrun by wild fires. The aircraft drops each munition 10 at precisely aimed points by releasing them from the bomb rack. Release of each munition 10 pulls its interconnected safety release enabling line 28 which closes safety switch 29. Fins 13 react with the slipstream to align nose portion 14 in a generally downwardly facing orientation with open end portion 16 facing upwardly. As munition 10 descends and glides to the target fire, altitude switch 22 closes at the preset altitude to feed enabling control signals over lead 22*a* to air-bag power module 30. After further descent, munition 10 impacts the forest canopy and G-switch 24 closes to produce activation control signals that are fed over lead 24*a* to air-bag power module 30. Source 30*b* of compressed gas or pyrotechnics is activated to expand air-bag structure 30*a* in air-bag power module 30. Expansion of air-bag structure 30*a* of air-bag power module 30 creates large internal pressure in chamber 15 that shears shear pins 18, ejects lid 17 and expels virtually all of fire retardant 40 through open end portion 16 and out of case 11 in the region of and upon its intended target(s). Both of impact switches 26 may be activated by impact to couple activation control signals over leads 26*a* to air-bag power module 30 to ensure that each air-bag power module 30 always functions after being dropped from an aircraft with a failure rate of less than one in a million.

Munition 10 can be used on any military aircraft capable of deploying MK80 Series general-purpose bombs, and can be deployed at several fires at different sites from a single aircraft. Munition 10 can be targeted accurately at single hot spots, isolated structures, along fire lines and internal to a fire zone, and can be deployed from high altitudes with great accuracy to control fires.

Many such munitions 10 can be quickly and accurately dropped to create a protected zone behind an area that has been made not to burn by munitions to protect fire fighters trapped in the path of runaway fires. This heretofore unavailable lifesaving barrier can be created by military crewmen without requiring any additional training beyond the training that military bomber crews already have.

Deployment of munitions 10 in support of firefighting efforts by the Forrest Service can be used to train and practice aircrews' bombing skills. Munitions 10 can be used for fire suppression when large, dangerous fires break out far from shores aboard large ships such as aircraft carriers and tankers, as well as offshore oil rigs. The biodegradable nature of the constituents of munition 10 can eliminate many of the problems associated with metallic clutter on practice bombing ranges and in national forests.

Munitions 10 not only can be carried to the area of a fire threat, they can be targeted more accurately under all visibility conditions to precise global positioning system (GPS) guided coordinates using military-fielded JDAM/JSOW kits and the guided wing kit marketed by Leigh Aerosystems Corp. of Carlsbad, Calif. under the trademark Longshot™. This guided wing kit has control circuitry and mechanisms responsive to entered GPS coordinate signals and remotely transmitted GPS signals from Navigational Satellite Arrangement (NAVSTAR) satellites and has been mounted on heavy pieces of ordnance. Furthermore, munitions 10 allows the use of the existing air assets of the U.S. Navy, Army, and Air Force to drop immense tonnage of bombs, and use these assets in firefighting efforts on such large scales that have no equal to satisfy a long felt need. Munitions 10 can be realistically scaled in size to the problem at hand.

Munition 10 of this invention provides a potential capability increase of up to two orders of magnitude over the existing technology. For example, a C-130 aircraft fitted with MAFFS can provide 3000 lbs. of retardant on a limited area; as compared to an Air Force B-52 bomber fitted with munitions 10 can drop in excess of 20,000 pounds of retardant at once or at numerous targeted sites.

Munitions 10 might permit the President and the Congress the opportunity to get politically involved with massive mobilization efforts of air equipment to combat/extinguish forest fires from far away distances with very little time-delay and no additional direct or indirect costs for airframe modification, and no need for other dedicated infrastructures like roads or water supplies. Munitions 10 of the invention innovates in a geopolitical realm to give new alternatives for safeguarding National Land/Forest Resources.

Having the teachings of this invention in mind, different applications, modifications and alternate embodiments of this invention may be adapted. Munition 10 of the invention can utilize alternative biodegradable materials for the structural elements of this device. Munition 10 can contain plant seed and fertilizer that are disbursed by aircraft in order to promote reforestation, with or without the fire retardant. For increased power during dispersion, air-bag power module 30 can be modified to utilize the dispersion methods used by fuel-air-explosive (FAE) bombs to disperse their liquid or powder payloads. Fuzing can also be achieved using conventional detonating/explosive fuzes.

The disclosed components and their arrangements as disclosed herein all contribute to the novel features of this invention. Munition 10 of this invention is a cost-effective tool to fight fires and may be dropped from a wide variety of aircraft including military aircraft to accurately and quickly deploy vast amounts of fire retardant on many wild fires throughout a vast region. Therefore, munition 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. A munition for fighting fire comprising:

a shell-shaped case having a chamber therein, said shell-shaped case having nose, cylindrical, and open end portions, said nose portion being connected to one end of said cylindrical portion, and said open end portion being connected to an opposite end of said cylindrical portion;

an air-bag power module in said chamber;

fire retardant contained in said chamber;

a lid disposed in said open end portion of said shell-shaped case to close said chamber, said lid being forcefully displaced from said open end portion by said air-bag module and said fire retardant being forcefully ejected from said chamber through said open end portion by said air-bag power module; and a plurality of switches on said shell-shaped case to provide control signals for said air-bag power module to create sudden forceful displacement of said lid from said open end portion by said air bag module and sudden forceful ejection of said fire retardant from said chamber and out of said shell-shaped case by said air-bag power module.

2. A method according of fighting fires comprising the steps of:

providing a plurality of munitions, each having shell-shaped cases each containing a chamber therein;

securing an air-bag power module in each chamber of each munition;

containing fire retardant in each chamber of each munition;

closing each chamber of each munition with a lid;

connecting switches on each munition to an air-bag power module;

stowing said munitions on bomb racks of an aircraft;

transiting said munitions aboard said aircraft to a fire;

dropping said munitions from said aircraft toward said fire; and providing signals from said switches for each air-bag power module to create sudden forceful displacement of each lid from each chamber by each air-bag power module and sudden forceful ejection of fire retardant from each chamber and out of each shell-shaped case by each air-bag power module to suppress said fire.

3. A munition according to claim 2 further comprising:

mounting lugs connected to said cylindrical portion of said shell-shaped case to connect to an aircraft bomb rack to allow air-dropping of said munition therefrom.

4. A munition for fighting fire comprising:

a shell-shaped case having a chamber therein, said shell-shaped case having nose, cylindrical, and open end portions, said nose portion being connected to one end of said cylindrical portion, and said open end portion being connected to an opposite end of said cylindrical portion;

an air-bag power module in said chamber;

fire retardant contained in said chamber;

a lid disposed in said open end portion of said shell-shaped case to close said chamber, said lid being forcefully displaced from said open end portion by said air-bag module and said fire retardant being forcefully ejected from said chamber through said open end portion by said air-bag power module;

a plurality of switches on said shell-shaped case to provide control signals for said air-bag power module to create sudden forceful displacement of said lid from said open end portion by said air bag module and sudden forceful ejection of said fire retardant from said chamber and out of said shell-shaped case by said air-bag power module;

mounting lugs connected to said cylindrical portion of said shell-shaped case to connect to an aircraft bomb rack to allow air-dropping of said munition therefrom; and fins mounted on said shell-shaped case to orient said nose portion in a downwardly direction and said open end portion in an upwardly facing direction during descent thereof to assure said ejection of said fire retardant upwardly and behind said shell-shaped case.

5. A munition according to claim 4 further comprising:

shear pins extending from said shell-shaped case to engage and hold said lid in said open end portion, said shear pins being sheared during said forceful displacement of said lid from said open end portion to remove said lid from said case.

6. A munition according to claim 5 wherein said air-bag power module is secured in said chamber adjacent to said nose portion to virtually completely eject said fire retardant from said chamber.

7. A munition according to claim 6 wherein said switches include a safety switch connected to said air-bag power module to prevent untimely activation of said air-bag power module during stowage and transit of said munition aboard said aircraft.

8. A munition according to claim 7 wherein said switches include an altitude switch to close at a preset altitude to feed enabling signals to said air-bag power module.

9. A munition according to claim 8 wherein said switches include a G-switch to create activation control signals for said air-bag power module when said shell-shaped case impacts a forest canopy.

10. A munition according to claim 9 wherein said switches include impact switches to create activation control signals for said air-bag power module when said shell-shaped case impacts ground.

11. A munition according to claim 10 wherein said case, fins, lid, and shear pins are made from biodegradable materials to reduce environmental impact.

12. A method according of fighting fires according to claim 2 wherein said step of providing a plurality of munitions includes the step of:

shaping each case to have nose, cylindrical, and open end portions, each nose portion being connected to one end of each cylindrical portion, and each open end portion being connected to an opposite end of each cylindrical portion.

13. A method according to claim 12 wherein said step of stowing includes the step of:

mounting each of said munitions on said bomb racks with lugs connected to each cylindrical portion of each case to allow accurate air-dropping of each munition therefrom.

14. A method according to claim 13 further comprising the step of:

securing fins on each munition to orient each nose portion in a downwardly direction and each open end portion in an upwardly facing direction during descent thereof to assure said ejection of fire retardant upwardly and behind each munition.

15. A method according to claim 14 further comprising the step of:

securing each air-bag power module in each chamber adjacent to each nose portion to virtually completely eject fire retardant from each chamber during said sudden forceful ejection.

16. A method according to claim 15 wherein said step of providing switches includes the steps of:

connecting a safety switch to each air-bag power module to prevent untimely activation of each air-bag power module during said steps of stowing and transiting;

connecting an altitude switch to close at a preset altitude to feed enabling signals to each air-bag power module;

creating activation control signals by a G-switch for each air-bag power module during impact of each munition with a forest canopy; and creating activation control signals by impact switches for each air-bag power module during impact of each munition with ground.

17. A method according to claim 16 further comprising the step of:

fabricating each shell-shaped case, fins, lid and shear pins of each munition from biodegradable materials to reduce environmental impact.

* * * * *